US007325490B2

(12) United States Patent
Haag et al.

(10) Patent No.: US 7,325,490 B2
(45) Date of Patent: Feb. 5, 2008

(54) RELIEF CYLINDER STRUCTURE OF A MULTINIP CALENDER

(75) Inventors: Jorma Haag, Karkkilä (FI); Keijo Laaksonen, Hyvinkää (FI)

(73) Assignee: Metso Paper, Inc., Helsinki (FI)

( * ) Notice: Subject to any disclaimer, the term of this patent is extended or adjusted under 35 U.S.C. 154(b) by 468 days.

(21) Appl. No.: 10/517,718

(22) PCT Filed: Jun. 9, 2003

(86) PCT No.: PCT/FI03/00452

§ 371 (c)(1),
(2), (4) Date: Dec. 10, 2004

(87) PCT Pub. No.: WO03/104554

PCT Pub. Date: Dec. 18, 2003

(65) Prior Publication Data

US 2005/0223887 A1 Oct. 13, 2005

(30) Foreign Application Priority Data

Jun. 10, 2002 (FI) ..... 20020278 U

(51) Int. Cl.
*B30B 3/04* (2006.01)

(52) U.S. Cl. ..... 100/161; 100/164; 100/163 A; 100/170

(58) Field of Classification Search ..... 100/161, 100/163 R, 164, 165, 163 A, 168, 169, 170; 91/169, 173; 92/51, 52, 65, 85 R, 85 B
See application file for complete search history.

(56) References Cited

U.S. PATENT DOCUMENTS 2,564,790 A * 8/1951 Orloff et al. ..... 267/64.15
3,083,000 A * 3/1963 Perdue ..... 267/64.26

(Continued)

FOREIGN PATENT DOCUMENTS

EP 0 842 324 B1 5/1998

(Continued)

OTHER PUBLICATIONS

International Preliminary Examination Report issued in PCT/FI03/00452.

(Continued)

*Primary Examiner*—Jimmy T. Nguyen
(74) *Attorney, Agent, or Firm*—Stiennon & Stiennon

(57) ABSTRACT

A relief cylinder structure for guiding a roll in a multinip calender has a frame and an arm that is arranged to move linearly in relation to the frame. A quick-opening cylinder is placed inside the arm. In a fault situation, the relief cylinder causes the cylinder rolls to move rapidly further away from each other. An auxiliary coupling (8) opens in a fault situation, wherein the pressure produced in the quick-opening cylinder (6) is discharged to a hydraulic system in a substantially non-pressurized state. The pressure of the quick-opening cylinder (6) is thus reduced below the pressure of the main cylinder (4), wherein the auxiliary piston (7) moves towards the end of the arm (3). Because the volume of the main cylinder (4) grows in accordance with the cylindrical space formed inside the arm (3), the volume restricted by the frame (2) of the relief cylinder (1) is reduced.

5 Claims, 2 Drawing Sheets

U.S. PATENT DOCUMENTS

| | | | | |
|---|---|---|---|---|
| 3,442,178 | A * | 5/1969 | Daniels | 91/403 |
| 3,905,278 | A * | 9/1975 | Ourdouillie | 92/10 |
| 4,736,678 | A * | 4/1988 | Stotz | 100/163 A |
| 4,859,006 | A * | 8/1989 | Philippe et al. | 305/148 |
| 4,924,772 | A * | 5/1990 | Schlunke et al. | 100/163 R |
| 5,024,465 | A * | 6/1991 | Baiker | 280/6.154 |
| 5,111,735 | A | 5/1992 | Johnson | |
| 5,806,415 | A * | 9/1998 | Lipponen et al. | 100/35 |
| 2001/0018869 | A1 | 9/2001 | Schneid et al. | |

FOREIGN PATENT DOCUMENTS

| | | |
|---|---|---|
| WO | A1 97/42375 | 11/1997 |
| WO | A1 03/104554 | 12/2003 |

OTHER PUBLICATIONS

International Search Report issued in PCT/FI03/00452.

* cited by examiner

RELIEF CYLINDER STRUCTURE OF A MULTINIP CALENDER

CROSS REFERENCES TO RELATED APPLICATIONS

This application is a U.S. national stage application of PCT App. No. PCT/FI03/00452, filed Jun. 9, 2003, the disclosure of which is incorporated by reference herein, and claims priority on Finnish Application U20020278, Filed Jun. 10, 2002.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a relief cylinder structure for guiding the roll of a multinip calender. The invention also relates to an arm used in a relief cylinder structure.

A paper web is calendered by passing it through at least one calender nip. It is a known process to use a so-called soft calender in which the web is passed through a nip formed by a hard-faced metal roll and a soft-faced roll. The soft-faced roll is typically formed by coating the roll frame with a suitable polymer material.

The calender may also contain several nips successively in the travel direction of the web W. The soft-calender may be composed of two successive pairs of a hard roll and a soft roll. Multinip calenders comprise several rolls successively, for example on top of each other, and in them the number of rolls is larger than in soft-calenders, typically 6 to 12. In multinip calenders the web W travels through nips formed between successive rolls. Some of the rolls are soft-faced polymer rolls.

The polymer coating of the calender rolls is an easily damaging component of the machine. If the use of the roll in production continues in spite of the incipient damage, the damage grows, causes defects in the production quality (marking of paper), production breaks (unplanned stoppage resulting from the changing of the damaged roll), and in the worst case risks in occupational safety (sudden loosening of the damaged coating, pieces of coating flying rapidly in the environment).

To be able to prevent damages in the calender in fault situations, the rolls of multiroll calenders must be guided rapidly and accurately away from each other in a fault situation. The loading of rolls during use is typically adjusted by means of hydraulic relief cylinders, whereby it is advantageous to combine quick opening of rolls with the function of the relief cylinders.

Patent publication EP 0 842 324 discloses a relief cylinder structure in which the liquid volume of the cylinder can be altered rapidly and accurately. The basic idea is that the relief cylinder structure comprises an actual relief cylinder and a quick-opening cylinder that affect each other by means of an intermediate structure. In a normal use situation both spaces are in a pressurized state and they both have a predetermined volume. In a fault situation the working pressure is conveyed away from the quick-opening cylinder, wherein the pressure of the relief cylinder transfers the intermediate structure and reduces the volume of the quick-opening cylinder. As a result of the depressurization of the quick-opening cylinder the total length of the entire cylinder structure is shortened. The shortening takes place rapidly, and its length can be determined accurately by means of the dimensioning of the quick-opening cylinder. In a solution of prior art, the quick-opening cylinder and the control devices necessary for the same are placed outside the cylinder structure, typically on the side of the cylinder structure, said solution requiring a considerable amount of space around itself.

SUMMARY OF THE INVENTION

The main purpose of the present invention is to provide a relief cylinder structure that enables the making of a smaller-sized relief cylinder structure.

To attain this purpose, the relief cylinder structure according to the invention is primarily characterized in that said relief cylinder structure comprises at least a frame, an arm that is arranged to move linearly in relation to the frame, a quick-opening cylinder and a hydraulic coupling, wherein the quick-opening cylinder is placed inside the arm.

The invention further relates to an arm used in a relief cylinder structure, said arm being primarily characterized in that the arm comprises at least a quick-opening cylinder placed therein.

The basic idea of the invention is to implement a relief cylinder structure in such a manner that its quick-opening cylinder is placed inside the arm of the relief cylinder. By means of the structure according to the invention it is in a fault situation possible to rapidly change the shape and size of the arm in relation to the main cylinder of the relief cylinder, thus producing a fast movement of the cylinder.

In the normal operating position, a moving piston located in the quick-opening cylinder is in such a position that the volume of the quick-opening cylinder is at its largest, and the end of the arm extending towards the main cylinder of the relief cylinder is substantially straight. The length of the relief cylinder structure is advantageously adjusted by adjusting the pressure of the main cylinder of the relief cylinder.

In a fault situation, the relief cylinder structure can be shortened rapidly when the quick-opening cylinder is emptied, i.e. in practice its control valve is opened. Thus, the pressure of the main cylinder pushes the piston in the quick-opening cylinder towards the end of the arm, wherein the volume of the main cylinder tends to grow. The external pressing force, however, remains substantially the same and effects the compression of the structure.

The compression of the structure substantially corresponds to the change in the volume of the quick-opening cylinder, i.e. by means of a small volume a small movement is attained and by means of a large volume a broad movement is attained. Because the quick-opening movement is proportional to the volume of the quick-opening cylinder, it is possible to accurately determine the breadth of the quick-opening movement, and thus to attain a fast and accurate opening movement in case of a fault situation.

By placing the quick-opening cylinder inside the arm of the relief cylinder in accordance with the invention, it is possible to attain such a relief cylinder structure that external devices relating to the quick-opening process are not required in the middle of the same. By means of the relief cylinder structure according to the invention it is possible to use such solutions in a multinip calender that have not been possible in relief cylinder structures of prior art.

Furthermore, the structure of a relief cylinder enabling the quick-opening according to the invention requires a smaller number of parts, and at the same time it can be implemented more easily than solutions of prior art.

BRIEF DESCRIPTION OF THE DRAWINGS

In the following, the invention will be described in more detail with reference to the appended principle drawings.

DESCRIPTION OF THE PREFERRED EMBODIMENTS

Figure 1:
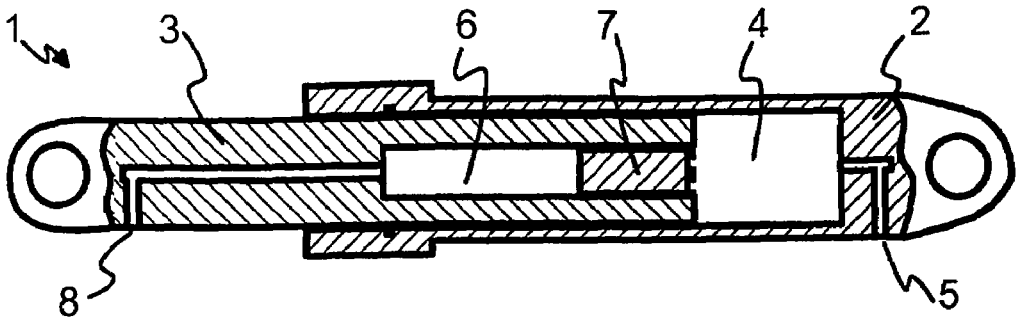
FIG. 1 shows a relief cylinder according to the invention when the cylinder is in the working position.

FIG. 1 shows an embodiment of the relief cylinder structure 1 according to the invention that comprises a cylinder frame 2 and a piston-like arm 3 arranged to move therein. Inside the frame 2, in the area defined by the arm, an area is formed, for which the term main cylinder 4 will be used hereinbelow. To the main cylinder 4 is connected a hydraulic coupling 5 placed in the frame 2, the term main coupling 5 being used hereinbelow for said coupling. The other end of the main coupling 5 is advantageously placed close to the end of the frame 2, from which it can be easily connected to the hydraulic system. The gap between the frame 2 and the arm 3 is advantageously sealed in a known manner.

According to the invention, a quick-opening cylinder 6 is arranged inside the arm 3, and an auxiliary piston 7 is arranged to move therein. To the quick-opening cylinder 6 is connected a hydraulic coupling 8, the term auxiliary coupling 8 being used for said coupling hereinbelow. The auxiliary coupling 8 is advantageously placed in such a manner that its other end is positioned close to the end of the arm 3. Thus, the auxiliary coupling 8 can be connected to the hydraulic system in such a manner that the joints are well protected against external damaging factors.

In the following, the function of a relief cylinder structure 1 according to the example will be described in a normal operating position according to FIG. 1 and in the quick-opening situation of FIG. 2.

In the operating position the relief cylinder structure 1 is typically at its longest, wherein the nips between the superimposed rolls of the calender become as low as possible. In the relief cylinder structure 1 according to the invention, pressure is supplied from the hydraulic system both to the main coupling 5 and to the auxiliary coupling 8. Thus, the volume of the main cylinder 4 is increased when the arm 3 moves in relation to the frame 2 under the influence of the pressure produced via the main coupling 5, restricted by the counterforce produced by the roll.

Through the auxiliary coupling 8, pressure is conveyed to the quick-opening cylinder 6, and as a result of this a pressure effect is also exerted on the auxiliary piston 7. In the normal operating position at least the same, advantageously a slightly higher pressure is exerted on the quick-opening cylinder 6 than in the main cylinder 4. Thus, the auxiliary piston 7 is positioned in the manner shown in FIG. 1, wherein the volume of the quick-opening cylinder 6 is at its largest. After the pressure produced in the quick-opening cylinder 6, it is advantageous to close the hydraulic system leading to the auxiliary coupling 8 in such a manner that said pressure remains in the quick-opening cylinder. After the closing of the above-described pressure system it is advantageous to remove the pressure from said hydraulic system supplying the auxiliary coupling 8.

The adjustment measures relating to the size of the gap of the nip during use are advantageously implemented by adjusting the volume of the main cylinder 4 and thus the total length of the relief cylinder structure 1.

In a fault situation, when it is necessary to transfer the rolls in a controlled manner and rapidly further away from each other, it is typically not possible to adjust the volume of the main cylinder 4 via the main coupling 5 because of the substantially too long a period of time required by the same. In the solution according to the invention, the auxiliary coupling 8 is arranged open in a fault situation, wherein the pressure produced in the quick-opening cylinder 6 is discharged to the hydraulic system via the auxiliary coupling 8, said hydraulic system being arranged in a substantially non-pressurized state in the manner described hereinabove. As a result of opening the auxiliary coupling, the pressure of the quick-opening cylinder 6 is reduced below the pressure of the main cylinder 4, wherein the auxiliary piston 7 moves towards the end of the arm 3, to a position according to FIG. 2. Because the volume of the main cylinder 4 grows in accordance with the cylindrical space formed inside the arm 3, the volume restricted by the frame 2 of the relief cylinder 1 is reduced with an equal volume. Thus, the arm 3 moves such a distance inside the frame 2 that the volume of the main cylinder 4 remains substantially the same as in the operating situation, because the force of the roll producing the pressure effect also remains substantially the same in an operating and fault situation. As a result of the mutual movement of the arm 3 and the frame 2, the length of the relief cylinder 1 is reduced, wherein the roll correspondingly moves into an open position.

Because the opening movement of the relief cylinder attained in the quick opening is proportional to the volume of the quick-opening cylinder 6, it is possible to change the length of the opening movement by changing the volume of the quick-opening cylinder. In a preferred embodiment according to FIG. 3, the length of the auxiliary piston 7 is increased when compared to the embodiment of FIG. 2. Thus, the volume of the quick-opening cylinder 6 is reduced and the quick-opening movement (i.e. the movement of the frame 2 and the arm 3 with respect to each other) is reduced.

Figure 2:
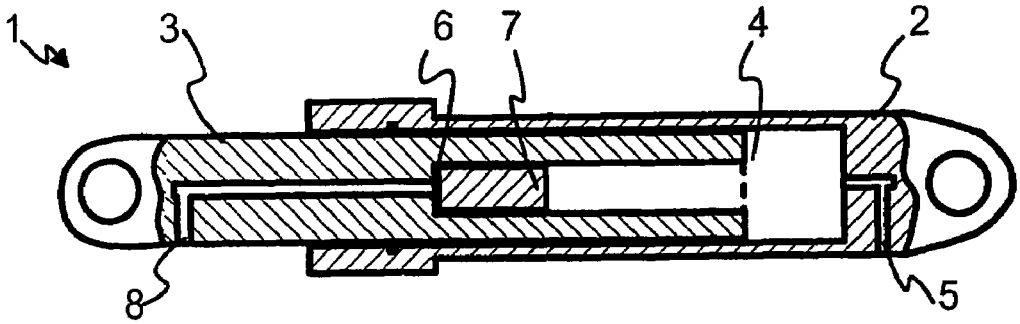
FIG. 2 shows the cylinder according to FIG. 1 in the quick-opening position.
Figure 3:
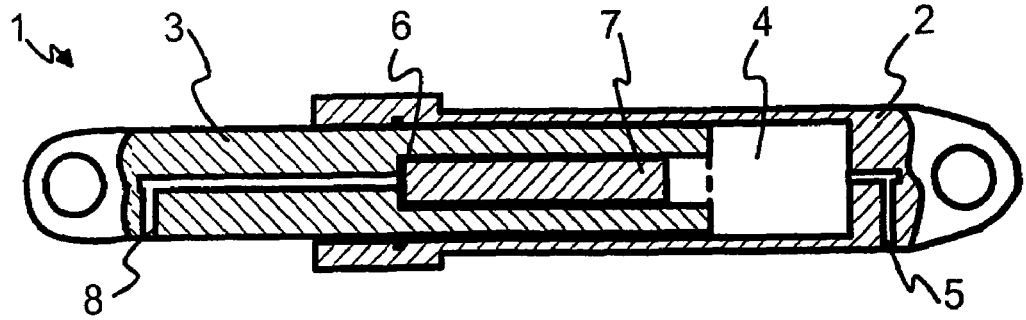
FIG. 3 shows an alternative embodiment of the invention in the quick-opening position.
Figure 4:
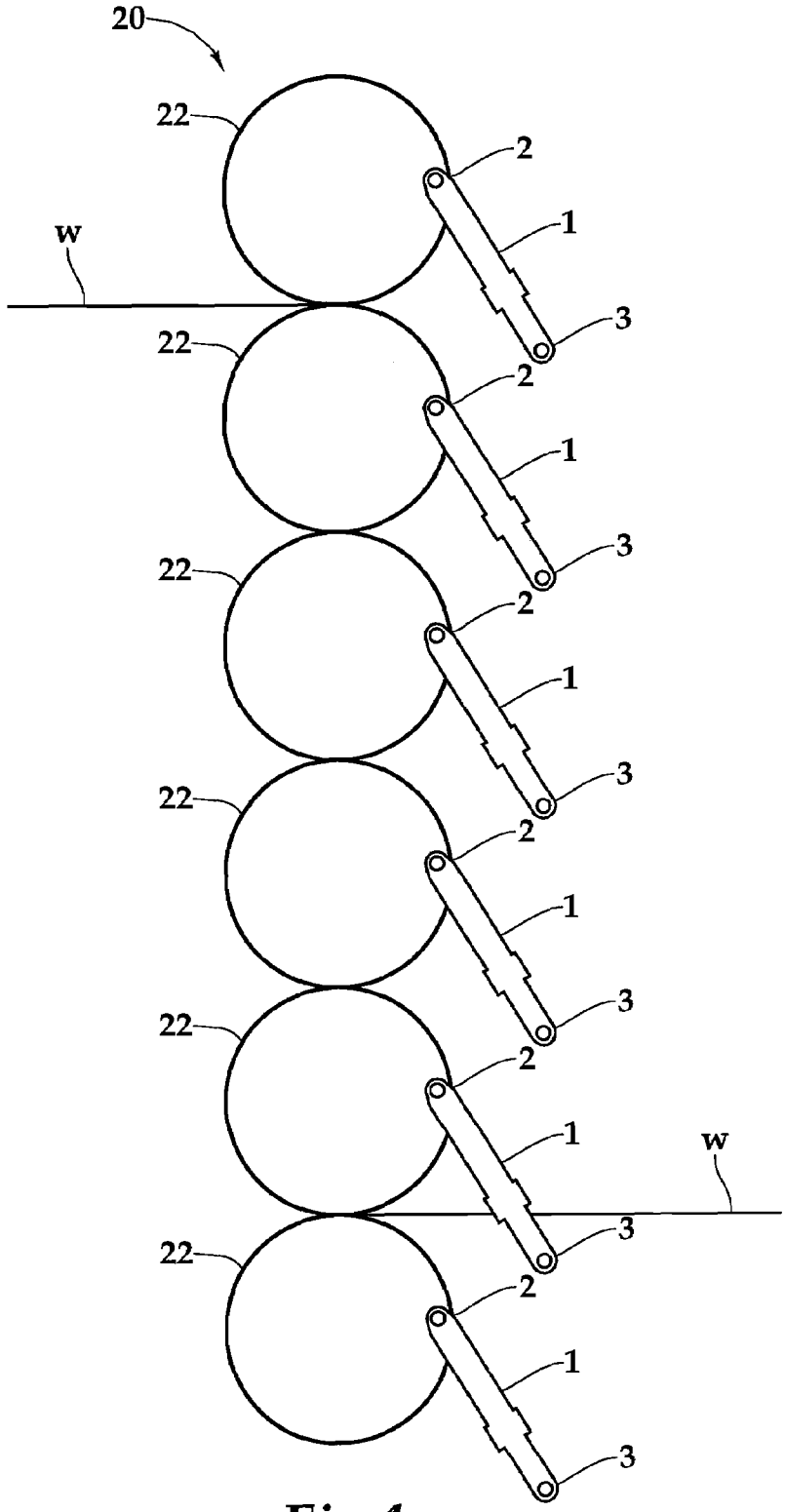
FIG. 4 is a schematic view showing a plurality of relief cylinder structures for guiding rolls in a multinip calender.

It is advantageous to implement the adjustment of the volume of the quick-opening cylinder 6 in the manner shown in FIGS. 2 and 3 by changing the length of the auxiliary piston 7, because the frame 2 of the relief cylinder 1 and the arm 3 are thus similar, irrespective of the volume of the quick-opening cylinder. This is especially advantageous when several different rolls are guided in a multinip calender 20 according to the invention, because it is possible to determine individual quick-opening dimensions for the rolls 22 on the basis of the dimensions of the auxiliary pistons 7, and still similar frame parts 2 and arm parts 3 of the relief cylinder are used in each roll, wherein maintenance can be arranged very economically.

It is, of course, obvious that the invention is not limited solely to the embodiment presented in the example above, but in the quick-opening process it is for example possible to guide the pressurized medium from the quick-opening cylinder 6 also to another location than to the hydraulic system in a manner deviating from the example. In the relief cylinder structure 1 according to the invention it is also possible to use any suitable pressurized medium, such as gas or liquid.

The invention claimed is:

1. A multinip calender comprising:

a first relief cylinder structure for guiding a roll of the multinip calender, the first relief cylinder structure further comprising:

a frame having a main cylinder therewithin;

a piston-like arm arranged to move within the main cylinder of the frame;

a main fluid coupling in the frame which communicates with the main cylinder of the frame;

portions of the piston-like arm which define a quick-opening cylinder arranged inside the arm;

a first auxiliary piston having a first length, the first auxiliary piston arranged to move within the quick-opening cylinder; and an auxiliary fluid coupling formed by portions of the arm which communicates with the quick-opening cylinder, wherein in a normal operating position pressure is supplied through the auxiliary fluid coupling to the quick-opening cylinder and through the main fluid coupling to the main cylinder, both said supplied pressures acting upon the first auxiliary piston, and wherein in a fault situation, the auxiliary fluid coupling is arranged to be open, wherein the pressure produced in the quick-opening cylinder is discharged to a fluid system via the auxiliary fluid coupling, said fluid system being arranged in a substantially non-pressurized state, as a result of opening the auxiliary coupling, the pressure of the quick-opening cylinder is reduced below the pressure of the main cylinder, wherein the first auxiliary piston moves within the quick-opening cylinder to increase the volume of the quick-opening cylinder in communication with the main cylinder, such that the piston-like arm is retracted within the frame reducing the length of the relief cylinder;

a second relief cylinder structure within the same multinip calender, wherein the second relief cylinder structure has a second auxiliary piston of a length different than the first length of the first auxiliary piston.

2. The multinip calender of claim 1 wherein the first auxiliary piston is arranged to move linearly in the quick-opening cylinder, in parallel to the arm and the frame.

3. A multinip calender, comprising:

first relief cylinder structure for guiding a roll of the multinip calender, the first relief cylinder structure further comprising:

a frame having portions defining an interior volume;

an arm arranged to move linearly in relation to the frame, and having portions which extend into the frame interior volume to define a main cylinder area between the arm and the frame;

a main fluid coupling which is in communication with the main cylinder area, wherein introduction of fluid through the main fluid coupling into the main cylinder area causes the arm to move in the frame;

portions of the arm which define a quick-opening cylinder interior volume;

an auxiliary fluid coupling is in communication with the quick-opening cylinder interior volume; and a first auxiliary piston having a first length, wherein the first auxiliary piston is movable within the quick-opening cylinder interior volume, the first auxiliary piston dividing the quick-opening cylinder interior volume into two portions which are sealed from one another by the first auxiliary piston, a first volume which is in communication with the auxiliary fluid coupling, and a second volume which is in communication with the main cylinder area, the sizes of the first volume and the second volume being variable with the movement of the first auxiliary piston; and a second relief cylinder structure within the same multinip calender, wherein the second relief cylinder structure has a second auxiliary piston of a length different than the first length of the first auxiliary piston.

4. The multinip calender of claim 3 wherein the first auxiliary piston is arranged to move linearly in the quick-opening cylinder interior volume, in parallel to the arm and the frame.

5. The multinip calender of claim 3 wherein the main fluid coupling is placed substantially at a first end of the frame, and the auxiliary fluid coupling is placed substantially at a first end of the arm.

* * * * *